US010328319B2

(12) United States Patent
Nakamura

(10) Patent No.: US 10,328,319 B2
(45) Date of Patent: Jun. 25, 2019

(54) GOLF CLUB HEAD

(71) Applicant: SUMITOMO RUBBER INDUSTRIES, LTD., Kobe-shi, Hyogo (JP)

(72) Inventor: Takashi Nakamura, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/952,515

(22) Filed: Apr. 13, 2018

(65) Prior Publication Data

US 2018/0296885 A1 Oct. 18, 2018

(30) Foreign Application Priority Data

Apr. 14, 2017 (JP) ..... 2017-080988

(51) Int. Cl.
*A63B 53/04* (2015.01)
*A63B 102/32* (2015.01)

(52) U.S. Cl.
CPC ..... *A63B 53/0466* (2013.01); *A63B 53/04* (2013.01); *A63B 2053/045* (2013.01); *A63B 2053/0408* (2013.01); *A63B 2053/0416* (2013.01); *A63B 2053/0437* (2013.01); *A63B 2102/32* (2015.10); *A63B 2209/00* (2013.01)

(58) Field of Classification Search
CPC ..... A63B 2053/0437; A63B 2053/045; A63B 53/0466; A63B 2053/0408; A63B 53/04
USPC ..... 473/346, 345, 332
See application file for complete search history.

(56) References Cited

U.S. PATENT DOCUMENTS

2002/0065147 A1* 5/2002 Sano ..... A63B 53/04 473/346
2005/0221913 A1* 10/2005 Kusumoto ..... A63B 53/0466 473/345
2007/0026966 A1* 2/2007 Sanchez ..... A63B 53/0466 473/349
2008/0214322 A1* 9/2008 Chou ..... A63B 53/0466 473/346
2009/0048037 A1* 2/2009 Llewellyn ..... A63B 53/0466 473/345
2012/0149494 A1* 6/2012 Takahashi ..... A63B 53/0466 473/345
2013/0109503 A1* 5/2013 Matsunaga ..... A63B 53/00 473/346

(Continued)

FOREIGN PATENT DOCUMENTS

JP 5882522 B1 3/2016

*Primary Examiner* — Benjamin Layno
(74) *Attorney, Agent, or Firm* — Birch, Stewart, Kolasch & Birch, LLP

(57) ABSTRACT

A golf club head according to the present invention includes a face portion, a crown portion and a sole portion, the crown portion including a first region extending in a toe-heel direction along at least part of the face portion, a second region arranged further on a back side than the first region, a step region extending in the toe-heel direction between the first region and the second region and extending downward toward the second region from the first region side, and at least one rib formed on an inner wall surface of the crown portion and extending in a face-back direction from at least the step region to the second region.

13 Claims, 7 Drawing Sheets

(56) References Cited

U.S. PATENT DOCUMENTS

| | | | | |
|---|---|---|---|---|
| 2014/0274448 | A1* | 9/2014 | Willett | A63B 53/04 473/327 |
| 2015/0094165 | A1* | 4/2015 | Cole | A63B 53/0466 473/332 |
| 2017/0050093 | A1* | 2/2017 | Mizutani | A63B 60/52 |

* cited by examiner

E1 Cross-section

GOLF CLUB HEAD

TECHNICAL FIELD

The present invention relates to a golf club head.

BACKGROUND ART

In recent years, as disclosed in JP 5882522, for example, golf club heads have been proposed in which a raised portion is provided on the crown portion and a sloped surface is formed as a step between the raised portion and the portion rearward thereof. This configuration enables the height of the face portion to be raised by the height of the raised portion. Thus, the rebound performance of the face portion can be improved. Also, on the crown portion, only the raised portion is formed higher, and the portion rearward thereof is formed at a lower position than the raised portion, enabling the center of gravity of the head to be lowered.

JP 5882522 is an example of related art.

SUMMARY OF THE INVENTION

However, even with a golf club head having a structure such as described above, there is room for improvement in order to enhance the rebound performance, and it is desired to further increase the carry distance. The present disclosure was made in order to solve the above problem, and an object thereof is to provide a golf club head that is able to further enhance the rebound performance in a golf club head that has a raised portion formed on the crown portion.

A golf club head according to the present invention is provided with a face portion, a crown portion and a sole portion, the crown portion including a first region extending in a toe-heel direction along at least part of the face portion, a second region arranged further on a back side than the first region, a step region extending in the toe-heel direction between the first region and the second region and extending downward toward the second region from the first region side, and at least one rib formed on an inner wall surface of the crown portion and extending in a face-back direction from at least the step region to the second region. Note that the "face-back direction", which is the direction in which the rib extends, need not be strictly in the face-back direction, and may slope at an angle.

In the above golf club head, the rib can be formed across the entire second region in the face-back direction.

In the above golf club heads, the rib can be formed to extend across the entire step region in the face-back direction.

In the above golf club heads, the rib can, in the first region, be formed to extend in the face-back direction, and to not reach a boundary between the crown portion and the face portion.

In the above golf club heads, the rib can be formed on a line extending in the face-back direction through a face center.

In the above golf club heads, the second region can be curved so as to be upwardly convex.

With a golf club head according to the present invention, the rebound performance can be further enhanced in a golf club head that has a raised portion formed on the crown portion.

EMBODIMENTS OF THE INVENTION

Hereinafter, an embodiment of a golf club head according to the present invention will be described, with reference to the drawings.

1. Overview of Golf Club Head

Figure 1:
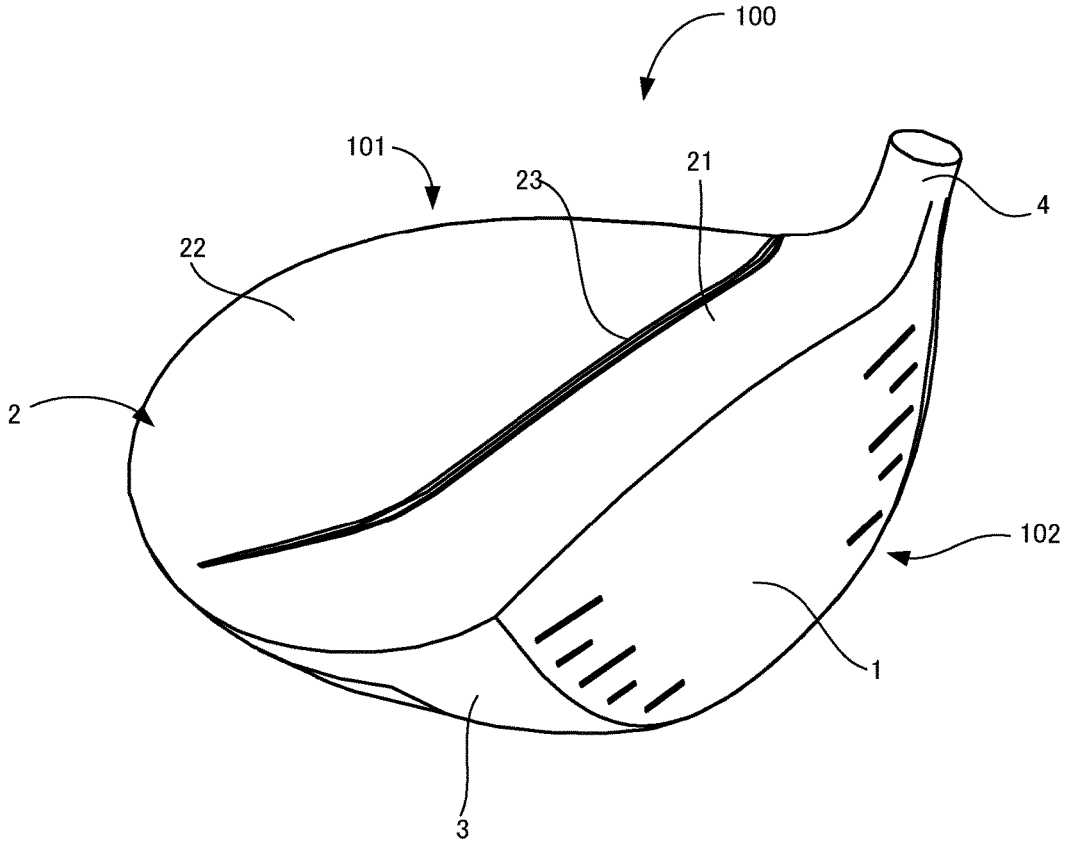
FIG. 1 is a perspective view of a reference state of a golf club head according to the present embodiment.
Figure 2:
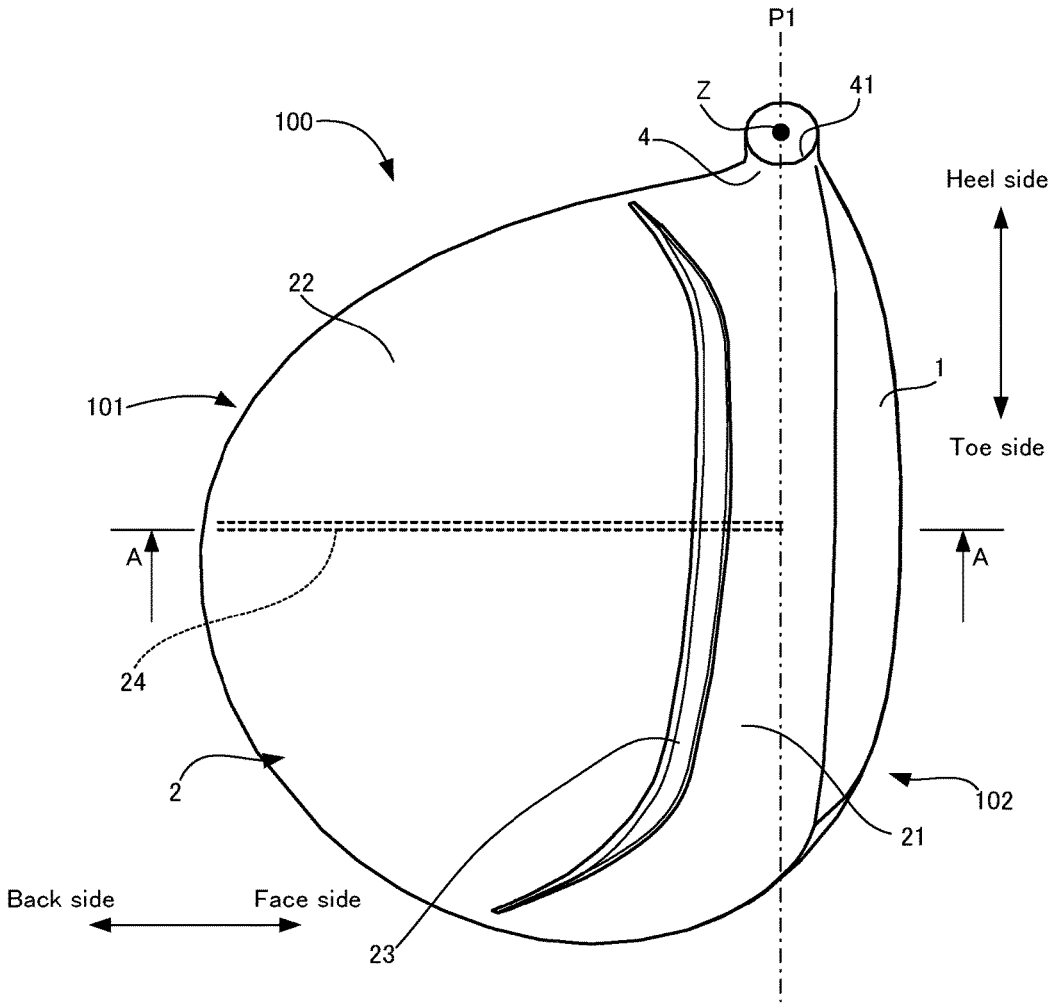
FIG. 2 is a plan view of FIG. 1.
Figure 3:
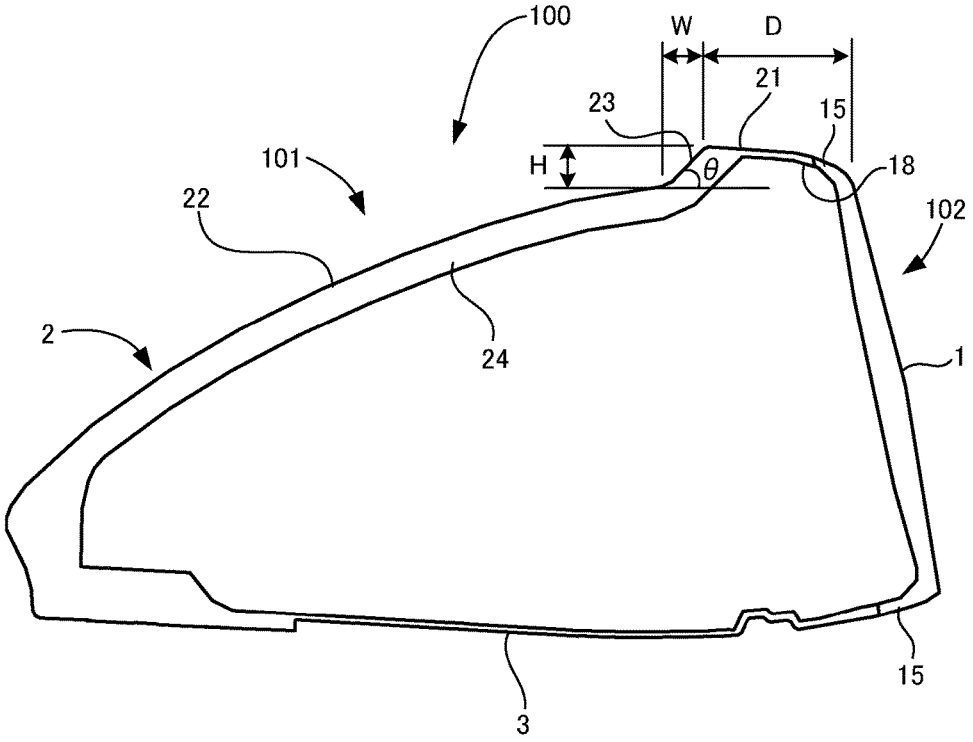
FIG. 3 is a cross-sectional view along an A-A line in FIG. 2.

FIG. 1 is a perspective view of this golf club head, FIG. 2 is a plan view of the head in a reference state, and FIG. 3 is a cross-sectional view along an A-A line in FIG. 2. As shown in FIGS. 1 to 3, this golf club head (hereinafter, may be simply referred to as "head") 100 is a wood-type golf club head having a hollow structure with an internal space, and a wall surface is formed by a face portion 1, a crown portion 2, a sole portion 3 and a hosel portion 4. Specifically, the present invention is applicable to golf club heads such as utilities, fairway woods and drivers.

The face portion 1 has a face surface which is the surface that hits the ball, and the crown portion 2 adjoins the face portion 1 and constitutes the upper surface of the head 100. The sole portion 3 mainly constitutes the bottom surface of the head 100, and constitutes the outer peripheral surface of the head 100 other than the face portion 1 and the crown portion 2. That is, besides the bottom surface of the head 100, the region extending from the toe side of the face portion 1 around the back side of the head to the heel side of the face portion 1 is also part of the sole portion 3. Furthermore, the hosel portion 4 is a region that is provided adjoining the heel side of the crown portion 2, and has an insertion hole 41 into which the shaft (illustration omitted) of the golf club is inserted. A center axis line Z of this insertion hole 41 coincides with the axis line of the shaft.

Here, the reference state when setting the golf club head 100 on the ground will be described. First, as shown in FIG. 2, a state where the above center axis line Z is contained in a plane P1 that is perpendicular to the ground and the head is placed on the ground at a predetermined lie angle and real loft angle is prescribed as the reference state. The above plane P1 will be referred to as the reference perpendicular plane. Also, as shown in FIG. 2, the line of intersection between the above reference perpendicular plane P1 and the ground will be referred to as the toe-heel direction, and the direction perpendicular to this toe-heel direction and parallel to the ground will be referred to as the face-back direction. Also, the direction that is orthogonal to the toe-heel direction and the face-back direction may be referred to as the up-down direction.

Figure 4A:
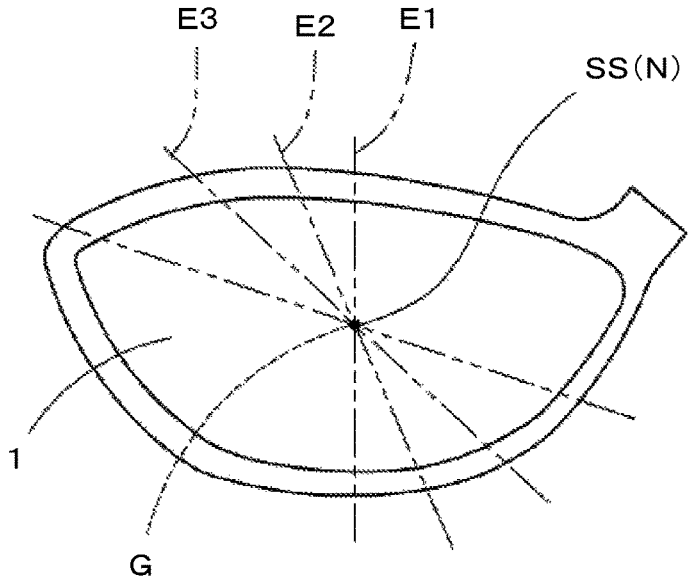
FIG. 4A is a diagram illustrating the boundary of a face portion.
Figure 4B:
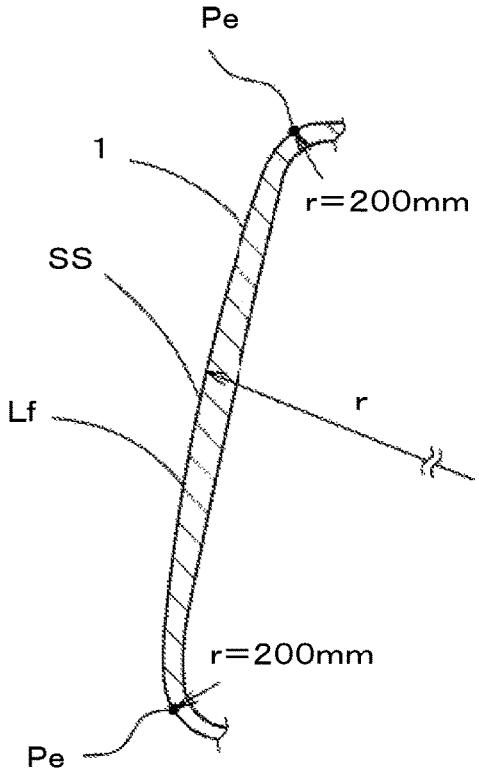
FIG. 4B is a diagram illustrating the boundary of the face portion.

In the present embodiment, the boundary between the face portion 1 and the crown portion 2 and between the face portion 1 and the sole portion 3 can be defined as follows. That is, in the case where a ridgeline is formed therebetween, this ridgeline will be the boundary. On the other hand, in the case where a clear ridgeline is not formed, in each of cross-sections E1, E2, E3 and so forth that contain a straight line N connecting a head center of gravity G and a sweet spot SS, as shown in FIG. 4A, a position Pe at which a curvature radius r of a contour line Lf of the face outer surface first reaches 200 mm in a direction toward the face outer side from the sweet spot side, as shown in FIG. 4B, will be the periphery of the face portion 1, and this periphery is defined as the boundary with the crown portion 2 or the sole portion 3. Note that the sweet spot SS is the point of intersection between the normal (straight line N) of the face surface that passes through the head center of gravity G and this face surface.

Also, in the present embodiment, the boundary between the crown portion 2 and the sole portion 3 can be defined as follows. That is, in the case where a ridgeline is formed between the crown portion 2 and the sole portion 3, this ridgeline will be the boundary. On the other hand, in the case where a clear ridgeline is not formed therebetween, the contour when the head is set in the reference state and viewed from directly above the center of gravity of the head 100 will be the boundary.

Also, the head 100 can, for example, be formed with a titanium alloy (Ti-6Al-4V, Ti-8Al-1Mo-1V, etc.) having a specific gravity of substantially about 4.3 to 4.5. Also, apart from a titanium alloy, the head can also be formed using one or two or more materials selected from stainless steel, maraging steel, an aluminum alloy, a magnesium alloy and an amorphous alloy, for example.

Also, the volume of this golf club head 100 is desirably from 90 $cm^3$ to 460 $cm^3$ inclusive, for example.

2. Assembly Structure of Golf Club Head

The golf club head 100 according to the present embodiment is constituted, as shown in FIG. 3, by assembling a head main body 101 having a crown portion 2 and a sole portion 3 and a cup-shaped face member 102 having a face portion 1 and a peripheral portion 15 extending from the periphery of the face portion. This head main body 101 has an opening 18 enclosed by the crown portion 2 and the sole portion 3, and the face member 102 is attached so as to close off this opening 18. That is, an end face of the peripheral portion 15 of the face member 102 is butted against an end face of the opening 18 of the head main body 101, and these portions are joined by welding (so-called cup face structure). The face member 102 is integrated with the head main body 101, by being attached to an edge portion of the opening 18 of the head main body 101, and the peripheral portion 15 of the face member 102 thereby functions as part of the crown portion 2 and the sole portion 3 of the head 100.

Accordingly, the surface that is integrally formed as a result of the peripheral portion 15 of the face member 102 being attached to the head main body 101 constitutes the crown portion 2 and the sole portion 3 of the head 100. Thus, strictly speaking, the crown portion 2 and the sole portion 3 of the head main body 101 are part of the crown portion 2 and the sole portion 3 of the head 100, although, in this specification, these portions of the head main body 101 may also be referred to simply as the crown portion 2 and the sole portion 3, without making this distinction.

3. Structure of Crown Portion

Next, the crown portion 2 will be described. As shown in FIGS. 1 to 3, the crown portion 2 is provided with a raised portion (first region) 21 that is arranged on the face portion side and a base portion (second region) 22 that is arranged further on the back side than the raised portion 21. The raised portion 21 is mainly a band-like region extending in the toe-heel direction along the face portion 1, with the respective end portions on the toe and heel sides extending slightly to the back side along the periphery of the crown portion 2, and is formed as a whole to be U-shaped in plan view. On the other hand, the base portion 22 is a region that occupies most of the crown portion 2 at a lower position than the raised portion 21, and the periphery thereof contacts the sole portion 3. A sloped surface (step region) 23 that constitutes a step is formed on the boundary between the raised portion 21 and the base portion 22. The height of the face portion 1 in the up-down direction is thereby increased by the amount of the step between the raised portion 21 and the base portion 22.

This sloped surface 23 is configured so as to extend upward, moving toward the face portion 1 side. The sloped surface 23 can thereby be sighted from above, when the golf club head 100 is set in the reference state. That is, the sloped surface can be sighted by the golfer at address. The sloped surface 23 is formed along the raised portion 21, and is thus formed to be U-shaped in plan view, similarly to the raised portion 21.

As shown in FIG. 3, a width D of the raised portion 21 in the face-back direction is, in plan view, preferably set from 5 to 25 mm, and more preferably from 7 to 20 mm, for example.

Also, a width W of the sloped surface 23 in the face-back direction in plan view is preferably set from 3 to 9 mm, and more preferably from 3 to 7 mm, for example. Furthermore, a height H of the sloped surface 23 is preferably set from 0.5 to 8 mm, more preferably from 0.5 to 6 mm, and particularly preferably from 0.5 to 5 mm, for example. Also, an angle θ that a horizontal line passing through a base end portion of the sloped surface 23 forms with the sloped surface 23 is preferably from 30 to 60 degrees.

The base portion 22 curves so as to be upwardly convex. For example, the curvature radius in the cross-section shown in FIG. 3 can be formed to be from 120 to 200 mm. The curvature radius can be formed such that when three points on the above line are prescribed, for example, the curvature radius increases approaching the front point.

Note that the cross-section in FIG. 3 is a cross-section in the face-back direction passing through a face center. The face center can be defined as follows. First, an arbitrary point Po is determined generally in a vicinity of the middle of the face portion 1 (face surface) in the toe-heel direction and the up-down direction. A line x extending in the toe-heel direction is drawn through this point Po, and a midpoint Px of this line x is determined. Next, on the face portion 1, a line y extending in the up-down direction is drawn through the point Px, and a midpoint Py of this line is determined. A process of redrawing the line extending in the toe-heel direction through the point Py determined in this way as the line x and thereafter redetermining the point Py in a similar manner to that described above is then repeatedly performed. A new point Py at which the distance between the previous point Py and the new point Py becomes 0.5 mm or less during the repetitions of this process is defined as the face center. Note that, more specifically, the above line x passing through the point Po is the line of intersection between the face surface (surface of the face portion 1) and a plane that contains the normal of the face surface passing through this point Po and is parallel to the toe-heel direction. Also, more specifically, the above line y passing through the point Px is the line of intersection between the face surface and a plane that contains the normal of the face surface passing through this point Px and is parallel to the up-down direction. Also, more specifically, the above line x passing through the point Py is the line of intersection between the face surface and a plane that contains the normal of the face surface passing through this point Py and is parallel to the toe-heel direction. Note that the lengths of the above lines x and y are measured along the face surface.

4. Structure of Inner Wall Surface of Crown Portion

Next, the structure of the inner wall surface of the crown portion 2 will be described. As shown in FIGS. 2 and 3, a rib 24 is formed on a line that passes through the above face center and extends in the face-back direction. The end portion on the face side of this rib 24 is connected to the inner wall surface of the raised portion 21 on the back side, and the end portion on the backside is connected to the inner wall surface of the end portion on the back side of the base portion 22. That is, this rib 24 extends from the raised portion 21 to the base portion 22 via the sloped surface 23, and extends across the entirety of the sloped surface 23 and the base portion 22 in the face-back direction.

The width of the rib 24 in the toe-heel direction can be set from 0.5 to 1.5 mm, for example. Also, the height of the rib 24 from the inner wall surface of the crown portion 2 can be set from 1.0 to 5.0 mm, for example.

The rib 24 need only be provided in a position within a range of 30 mm to the toe side and 30 mm to the heel side from the above face center, for example.

5. Manufacturing Method of Golf Club Head

Next, an example of the manufacturing method of the above golf club head will be described. First, the above-mentioned head main body 101 and face member 102 are prepared. A head main body 101 and a face member 102 such as described above can be produced with various methods. For example, the head main body 101 can be manufactured by casting such as a well-known lost wax precision casting process. Also, the face member 102 can be manufactured by a method such as forging, plate pressing or casting, for example. Also, the pre-processing plate of the face member 102 that is used at this time is processed such that the rolling direction substantially coincides with the direction from an upper portion on the toe side of the face portion 1 to a lower portion on the heel side.

The golf club head is then completed when predetermined coating is performed after joining these portions by welding (TIG (tungsten inert gas) welding, plasma welding, laser welding, brazing, etc.), for example.

6. Features

According to the above embodiment, the following effects can be obtained.

(1) In the crown portion 2, the raised portion 21 is formed higher than the base portion 22 via the sloped surface 23, thus enabling the height of the face portion 1 to be increased by the height of the raised portion 21. Thus, the rebound performance of the face portion 1 can be improved. Also, in the crown portion 2, only the raised portion 21 is formed higher, and the base portion 22 occupying most of the crown portion 2 is formed at a lower position than the raised portion 21, thus enabling the center of gravity of the head to be lowered.

(2) In the present embodiment, the rib 24 is provided on the inner wall surface of the crown portion 2, but in the case where, for example, this rib is not provided, the inventor found that the crown portion 2 exhibited the following behavior when the ball hit the face portion 1. This point will be described with reference to FIG. 5.

Figure 5:
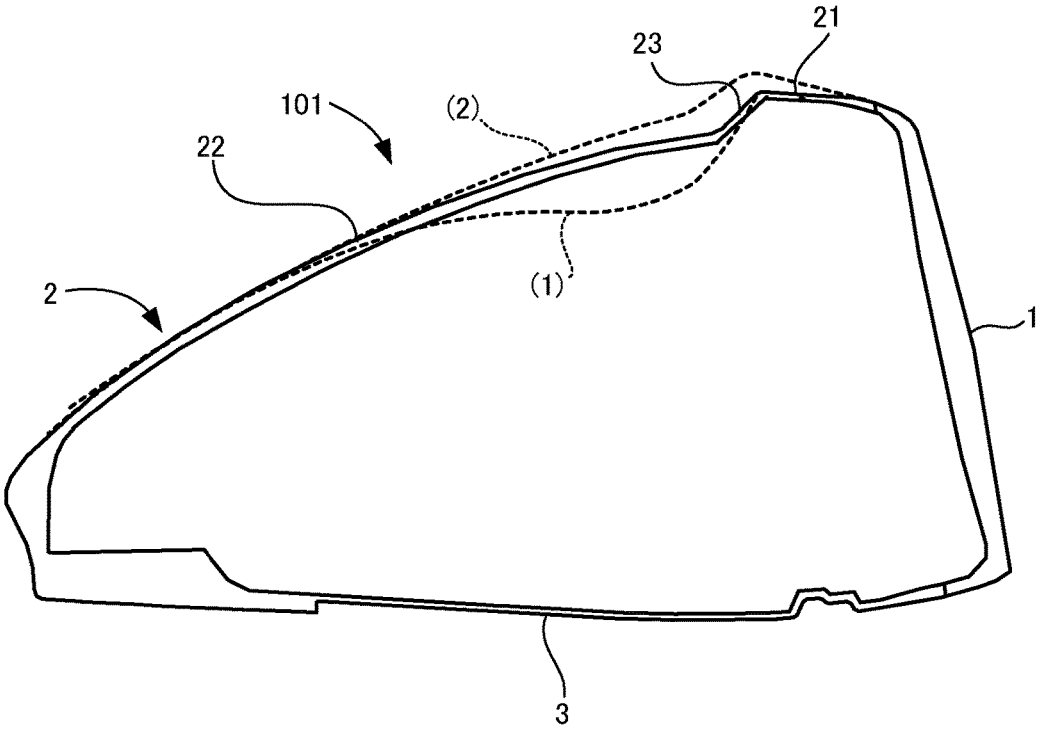
FIG. 5 is a cross-sectional view showing the case where a rib is not provided in the golf club head of FIGS. 1 to 3.

As shown in FIG. 5, when the ball hits the face portion 1, the crown portion 2 deforms as shown by the dashed lines. First, at impact when the ball hits the face portion 1, the crown portion 2 deforms such that the base portion 22 is pushed toward the sole portion 3 while the sloped surface 23 rises up steeply, as shown by the dashed line (1). When the ball separates from the face portion 1 in the latter part of impact, the crown portion 2 is restored from the dashed line (1), and deforms so as to bulge further upward, as shown by the dashed line (2). Following this, the crown portion 2 is restored to an initial shape, while repeatedly vibrating between the dashed lines (1) and (2). Thus, part of elastic energy stored by the deformation of the crown portion 2 in the early part of impact is converted to vibration of the crown portion 2, and energy for rebounding the ball is lost. It was thereby found that the problem of a reduction in rebound performance arises.

In contrast, when the rib 24 extending in the face-back direction is provided on the inner wall surface of the crown portion 2 such as in the present embodiment, the crown portion 2 can be prevented from deforming in the manner described above. That is, the crown portion 2 is prevented from being pushed downward due to the rib 24 which extends in the face-back direction, and the crown portion 2 vibrating in the up-down direction can thereby be suppressed. As a result, a reduction in rebound performance can be prevented. In particular, this rib 24 extends across the entirety of the base portion 22, and thus greatly contributes to suppressing the deformation of the base portion 22.

Figure 6:
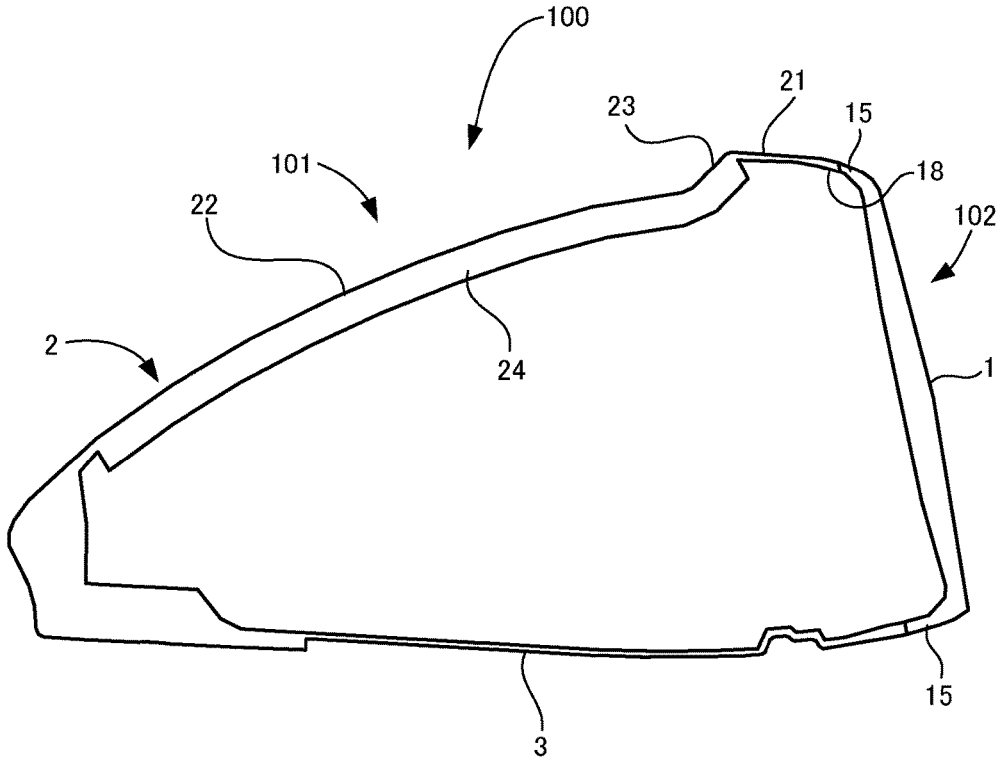
FIG. 6 is a plan view showing another example of FIG. 3.

(3) In the present embodiment, the respective end portions of the rib 24 are fixed to the inner wall surface of the raised portion 21 and the rear end portion of the crown portion 2. The effect of preventing deformation of the crown portion 2 obtained by the rib 24 can be enhanced more than in the case where, for example, there are portions that do not contact the inner wall surface of the head 100 at both ends of the rib 24, as shown in FIG. 6. The end portion on the face side of the rib 24 only extends partway along the raised portion 21, however, rather than reaching the face portion 1. Accordingly, deformation of the face portion 1 being inhibited is prevented.

(4) Since the crown portion 2 curves so as to be upwardly convex, pushing of the crown portion 2 toward the sole portion 3, at the time of the impact with the ball, as shown in the above FIG. 5, can be suppressed.

7. Variations

Although an embodiment of the present invention is described above, the present invention is not limited to the above embodiment, and various modifications can be made without departing from the spirit of the invention. Also, the following variations can be appropriately combined. Modifications such as the following can be made, for example.

<7-1>

In the above embodiment, the raised portion 21 and the sloped surface 23 are formed to be U-shaped in plan view, but are not limited thereto, and need only extend generally in the toe-heel direction. Accordingly, the raised portion 21 and the sloped surface 23 can also be formed in a band shape extending generally straight in the toe-heel direction, for example. Also, the sloped surface 23 may not necessarily be flat. For example, the sloped surface can also be formed to be curved. Furthermore, the region between the raised portion 21 and the base portion 22 need not necessarily be formed as a slope, and may be a step that extends in the up-down direction.

<7-2>

The rib 24 need only extend in the face-back direction on the inner wall surface of the crown portion 2, and the position thereof is not particularly limited. The rib 24 need only at least extend from the sloped surface 23 across to the base portion 22, and need not extend across the entirety of the sloped surface 23 and the base portion 22. Also, the rib 24 need not necessarily be formed on the raised portion 21.

Figure 7:
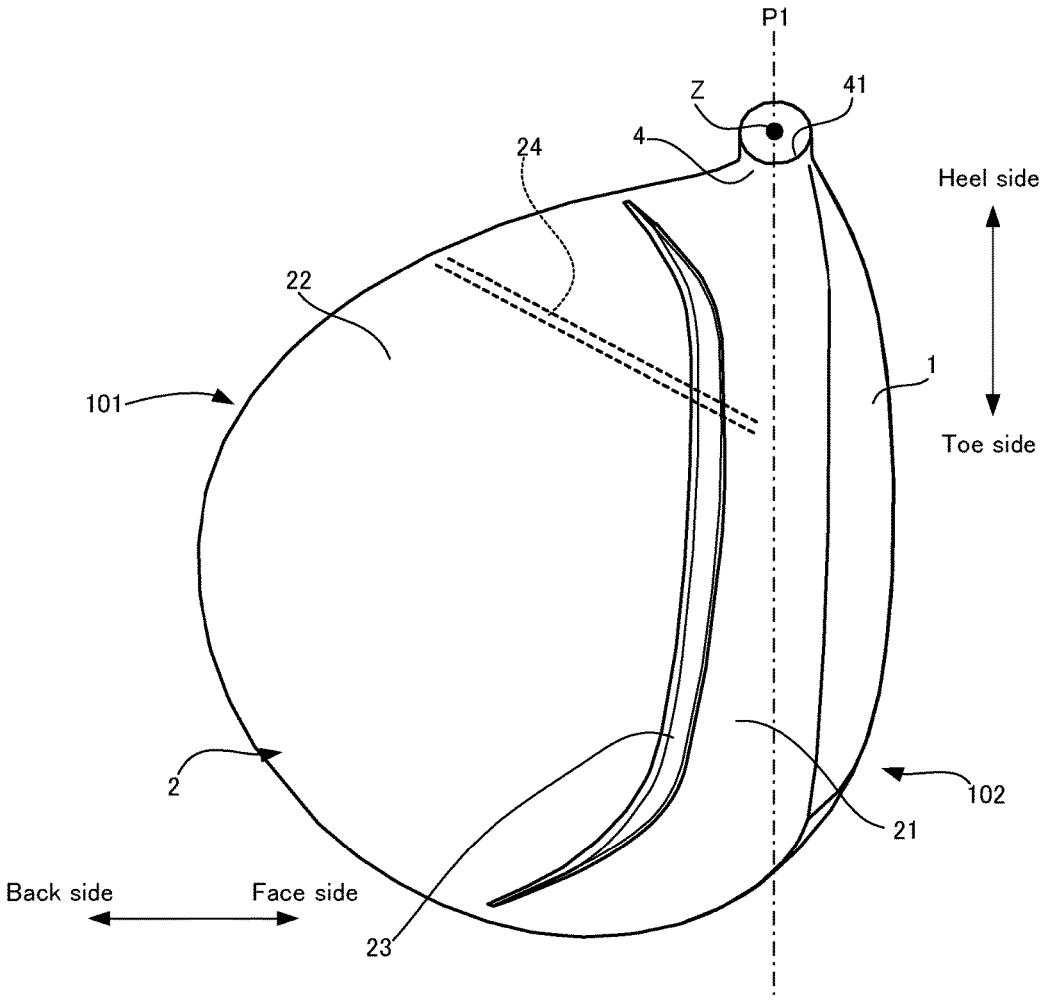
FIG. 7 is a plan view showing another example of FIG. 2.

Also, the position at which the rib 24 is provided is preferably on a line that passes through the face center and extends in the face-back direction, as described above, but is not limited thereto. For example, as shown in FIG. 7, a rib 24 that slopes at an angle so as to extend further on the heel side moving toward the back side from a position nearer the heel of the raised portion 21 can also be provided. In this way, the rib 24 need not strictly extend in the face-back direction, and may slope at an angle. A plurality of ribs 24 can also be formed. Also, as described above, when both end portions of the rib 24 are supported by the inner wall surface of the head, the effect of suppressing vibration obtained by the rib 24 is improved.

<7-3>

The head according to the above embodiment has a cup face structure, but other forms are possible. For example, the head can be constituted by fitting the crown portion 2 into an opening for the crown portion formed in a head main body that includes the face portion 1 and the sole portion 3. Also, a cup face structure need not be adopted, and the head can be constituted by fitting a plate-like face member into an opening formed in the face portion 1 and welding the face member to the head main body.

<7-4>

The sole portion 3 is not particularly limited in shape, and can, from a design or structural viewpoint, be appropriately provided with recessed portions or grooves, for example.

LIST OF REFERENCE NUMERALS

1 Face portion
2 Crown portion
21 Raised portion (first region)
22 Base portion (second region)
23 Sloped surface (step region)
24 Rib
3 Sole portion
4 Hosel portion

What is claimed is:

1. A golf club head comprising:
a face portion;
a crown portion; and
a sole portion,
wherein the crown portion includes:
a first region extending in a toe-heel direction along at least part of the face portion;
a second region arranged further on a back side of the crown than the first region;
a step region extending in the toe-heel direction, connecting the first region and the second region, and the step region extending downward along a sloped surface toward the second region from the first region side;
at least one rib formed on an inner wall surface of the crown portion, and extending in a face-back direction from the sloped surface to the second region, and
the rib is configured to extend upward along the sloped surface from the second region to the first region.

2. The golf club head according to claim 1, wherein the rib is formed across the entire second region in the face-back direction.

3. The golf club head according to claim 1, wherein the rib extends across the entire step region in the face-back direction.

4. The golf club head according to claim 1, wherein the rib is, in the first region, formed to extend in the face-back direction, and does not reach a boundary between the crown portion and the face portion.

5. The golf club head according to claim 1, wherein the rib is formed on a line extending in the face-back direction through a face center.

6. The golf club head according to claim 1, wherein the second region curves so as to be upwardly convex.

7. The golf club head according to claim 1, wherein the step region is formed to be substantially U-shaped in plan view.

8. The golf club head according to claim 1, wherein a plurality of the ribs is provided.

9. The golf club head according to claim 1, wherein the both end portions of the rib are supported by the inner wall surface of the golf club head.

10. The golf club head according to claim 1, wherein the rib slopes at an angle so as to extend further on the heel side moving toward the back side.

11. The golf club head according to claim 1, wherein a width of the sloped surface in the face-back direction in plan view is from 3 to 9 mm.

12. The golf club head according to claim 1, wherein a height of the sloped surface is from 0.5 to 8 mm.

13. The golf club head according to claim 1, wherein an angle that a horizontal line passing through a base end portion of the sloped surface forms with the sloped surface is from 30 to 60 degrees.

* * * * *